US010690309B2

(12) United States Patent
Gromfeld

(10) Patent No.: US 10,690,309 B2
(45) Date of Patent: Jun. 23, 2020

(54) OPTICAL MODULE FOR LIGHTING OVERHEAD LIGHTS

(71) Applicant: VALEO VISION, Bobigny (FR)

(72) Inventor: Yves Gromfeld, Angers (FR)

(73) Assignee: VALEO VISION, Bobigny (FR)

( * ) Notice: Subject to any disclaimer, the term of this patent is extended or adjusted under 35 U.S.C. 154(b) by 267 days.

(21) Appl. No.: 15/693,629

(22) Filed: Sep. 1, 2017

(65) Prior Publication Data

US 2018/0058651 A1 Mar. 1, 2018

(30) Foreign Application Priority Data

Sep. 1, 2016 (FR) ..... 16 58120

(51) Int. Cl.
*F21S 41/32* (2018.01)
*F21S 41/25* (2018.01)
(Continued)

(52) U.S. Cl.
CPC ..... *F21S 41/322* (2018.01); *F21S 41/147* (2018.01); *F21S 41/24* (2018.01); *F21S 41/25* (2018.01);
(Continued)

(58) Field of Classification Search
CPC ..... F21S 41/24; F21S 41/25; F21S 41/322; F21S 41/147; F21S 41/40; F21S 41/43; F21S 41/435; F21S 43/315
See application file for complete search history.

(56) References Cited

U.S. PATENT DOCUMENTS

2005/0068787 A1 3/2005 Ishida
2008/0239745 A1* 10/2008 Naganawa ..... F21S 41/147 362/516
(Continued)

FOREIGN PATENT DOCUMENTS

CN 105066062 11/2015
DE 10 2004 047 301 A1 5/2005
(Continued)

OTHER PUBLICATIONS

French Preliminary Search Report dated May 11, 2017 in French Application 16 58120, filed on Sep. 1, 2016 ( with English Translation of Categories of Cited Documents).
(Continued)

*Primary Examiner* — Suezu Ellis
(74) *Attorney, Agent, or Firm* — Oblon, McClelland, Maier & Neustadt, L.L.P.

(57) ABSTRACT

An optical module for motor vehicle including at least one light source capable of emitting an initial light beam and a primary optical means capable of receiving the initial light beam and having a cutoff member arranged to transform the initial light beam into a secondary light beam oriented in a longitudinal direction and exhibiting a predetermined bottom cutoff extending overall transversely. A projection means is arranged to project a final light beam exhibiting a top cutoff formed by an inverted image of the secondary light beam with cutoff, wherein the primary optical means has a light deflection member arranged to deflect a part of the light rays of the initial light beam below the cutoff of the secondary beam toward the projection means.

18 Claims, 4 Drawing Sheets

(51) Int. Cl.

| | |
|---|---|
| ***F21S 41/265*** | (2018.01) |
| ***F21S 41/27*** | (2018.01) |
| ***F21S 41/24*** | (2018.01) |
| ***F21S 41/14*** | (2018.01) |
| ***F21S 41/147*** | (2018.01) |
| ***F21S 41/20*** | (2018.01) |
| ***F21S 41/26*** | (2018.01) |
| ***F21S 41/663*** | (2018.01) |
| ***F21S 41/40*** | (2018.01) |
| *F21W 102/18* | (2018.01) |

(52) U.S. Cl.
CPC ..... *F21S 41/26* (2018.01); *F21S 41/265* (2018.01); *F21S 41/27* (2018.01); *F21S 41/285* (2018.01); *F21S 41/40* (2018.01); *F21S 41/663* (2018.01); *F21W 2102/18* (2018.01)

(56) References Cited

U.S. PATENT DOCUMENTS

| | | | | |
|---|---|---|---|---|
| 2009/0073710 | A1* | 3/2009 | Sormani | G02B 6/0028 362/509 |
| 2016/0040848 | A1* | 2/2016 | Tsukamoto | F21S 41/19 362/509 |
| 2016/0178155 | A1 | 6/2016 | Owada | |
| 2017/0009950 | A1 | 1/2017 | Lin et al. | |
| 2017/0009951 | A1 | 1/2017 | Lin et al. | |
| 2017/0211771 | A1* | 7/2017 | Nishimura | F21S 41/322 |

FOREIGN PATENT DOCUMENTS

| | | | |
|---|---|---|---|
| DE | 10 2008 015 510 | A1 | 10/2008 |
| DE | 10 2015 215 200 | A1 | 2/2016 |
| EP | 2 730 836 | A1 | 5/2014 |
| EP | 3 037 716 | A1 | 6/2016 |
| JP | 2010-170836 | | 8/2010 |

OTHER PUBLICATIONS

Chinese Office Action with English translation dated Feb. 21, 2020 in corresponding Chinese Patent Application No. 201710777155.X (13 pages).

* cited by examiner

OPTICAL MODULE FOR LIGHTING OVERHEAD LIGHTS

TECHNICAL FIELD OF THE INVENTION

The invention relates to an optical module for motor vehicle intended to project a final light beam with top cutoff.

The invention relates more particularly to an optical module for a motor vehicle comprising:

- at least one light source capable of emitting an initial light beam,
- a primary optical means capable of receiving said initial light beam and comprising a cutoff member arranged to transform said initial light beam into a secondary light beam oriented in a longitudinal direction and exhibiting a predetermined bottom cutoff extending overall transversely,
- a projection means arranged to project a final light beam exhibiting a top cutoff formed by an inverted image of the secondary light beam with cutoff.

TECHNICAL BACKGROUND OF THE INVENTION

Optical modules are already known that are intended to emit light beams with cutoff. The cutoff profile extends overall transversely so as to mark a boundary between a bottom zone which is lit by the light beam and a top zone in which the light beam gives almost no lighting. This cutoff thus makes it possible to control the range of the light beam in order to avoid dazzling the drivers of vehicles located in front of the vehicle.

A low beam function is notably produced by means of such a beam with cutoff. The cutoff can exhibit a purely horizontal profile, a staged profile separated by an inclined cutoff portion, or even a "V"-shaped profile, exhibiting a horizontal portion and a rising inclined portion, for example with an angle of 15° relative to the horizontal portion.

Some regulations allow certain points situated above the cutoff to be lit by the light beam. These points are generally called "overhead lights", because they correspond to the lighting of zones situated above other vehicles, at the point where some signaling panels are arranged on gantries over the road.

The position of the overhead lights relative to the vehicle, and the light intensity with which they are lit are imposed by very strict regulations.

It has already been proposed to produce the lighting of these overhead lights by modifying the structure of a projection lens of the optical module.

However, the projection lens is directly visible from the outside of the vehicle. Such a structural modification of the lens is therefore perceptible to an outside observer. These solutions are not therefore esthetically satisfactory.

It has also been proposed to arrange mirrors to reflect light rays upward toward the overhead lights.

However, such a solution dictates the use of an additional reflection element which is added to the optical module. Such an element is bulky and costly to install.

BRIEF SUMMARY OF THE INVENTION

The present invention proposes an optical module of the type described previously, characterized in that the primary optical means comprises a light deflection member arranged to deflect a part of the light rays of the initial light beam below the cutoff of the secondary beam toward the projection means.

According to other features of the invention:

- the primary optical means is a solid part produced in a translucent or transparent material;
- the cutoff member is formed by a slot produced in a bottom face of the primary optical means which has a top transverse cutoff edge whose profile corresponds to the form of the predetermined cutoff, the cutoff profile being able to be a rectilinear profile or, as a variant, a profile having a horizontal portion and an oblique portion forming an angle with the horizontal portion, notably an angle of 15°;
- the cutoff edge is formed at the intersection between:
  - a first upstream interception face, notably substantially horizontal, which is arranged to reflect all the light rays from the light sources above the cutoff edge toward the projection means, and
  - a downstream second face, notably substantially vertical, which extends below the cutoff edge, this downstream second face being arranged to intercept none of the light rays not being deflected by the deflection member;
- the deflection member is formed by an exit face produced in the primary optical means, notably upstream of the cutoff edge, notably in the interception face, the exit face forming an angle with the interception face so as to transmit a part of the initial beam out of the primary optical means, notably below the cutoff edge, for example toward the downstream second face of the cutoff member;
- the exit face is produced in a bulge extending protrudingly outward under the interception face;
- the exit face is produced in a notch hollowed out in the interception face;
- the light rays deflected by the deflection member are projected above the cutoff line of the final beam, to produce a regulatory so-called "overhead lights" function, the deflected light rays exiting through the exit face being notably directed toward the downstream face of the cutoff member, the exit face cooperating with the downstream face so that the light rays deflected by the exit face and passing through said portion of downstream face produce said regulatory overhead lights function;
- the primary optical means comprises at least one collimation member, notably a collimator, for collimating the light rays emitted by an associated light source;
- the primary optical means comprises an internal total reflection face which is arranged to receive the collimated light beam and to focus it at the level of the cutoff member;
- the optical module comprises an output face arranged downstream of the cutoff member;
- the projection means is focussed at the level of the cutoff member;
- the projection means has a transverse focal line which coincides with the edge of the cutoff member;
- the projection means is formed by a lens.

The invention relates also to a light device for motor vehicle comprising a first optical module produced according to any one of the preceding claims, and comprising a second optical module capable of producing a segmented beam intended to be switched on jointly with the light beam projected by the first optical module to produce a lighting function of regulatory low beam type by superpositioning of the two light beams.

BRIEF DESCRIPTION OF THE FIGURES

Other features and advantages of the invention will emerge while reading the following detailed description, for an understanding of which reference will be made to the attached drawings in which.

DETAILED DESCRIPTION OF THE FIGURES

Hereinafter in the description, the following orientations will be adopted in a nonlimiting manner:

- longitudinal, directed from back to front in the direction of output of the final light beam;
- vertical, directed from bottom to top;
- transverse, directed orthogonally to the longitudinal and vertical directions.

A longitudinal transverse plane will be called "horizontal" plane.

Hereinafter in the description, the terms "upstream" and "downstream" will be used with reference to the direction of movement of the light rays from a light source to a final light beam.

The transverse orientation corresponds to the orientation of the horizontal level of the cutoff profile of the final light beam. The vertical orientation is used as geometrical coordinate without reference to the direction of gravity. The vertical orientation is defined as being orthogonal to the horizontal level of the cutoff profile of the final light beam.

Hereinafter in the description, elements having the same structure or similar functions will be denoted by the same references.

Figure 1:
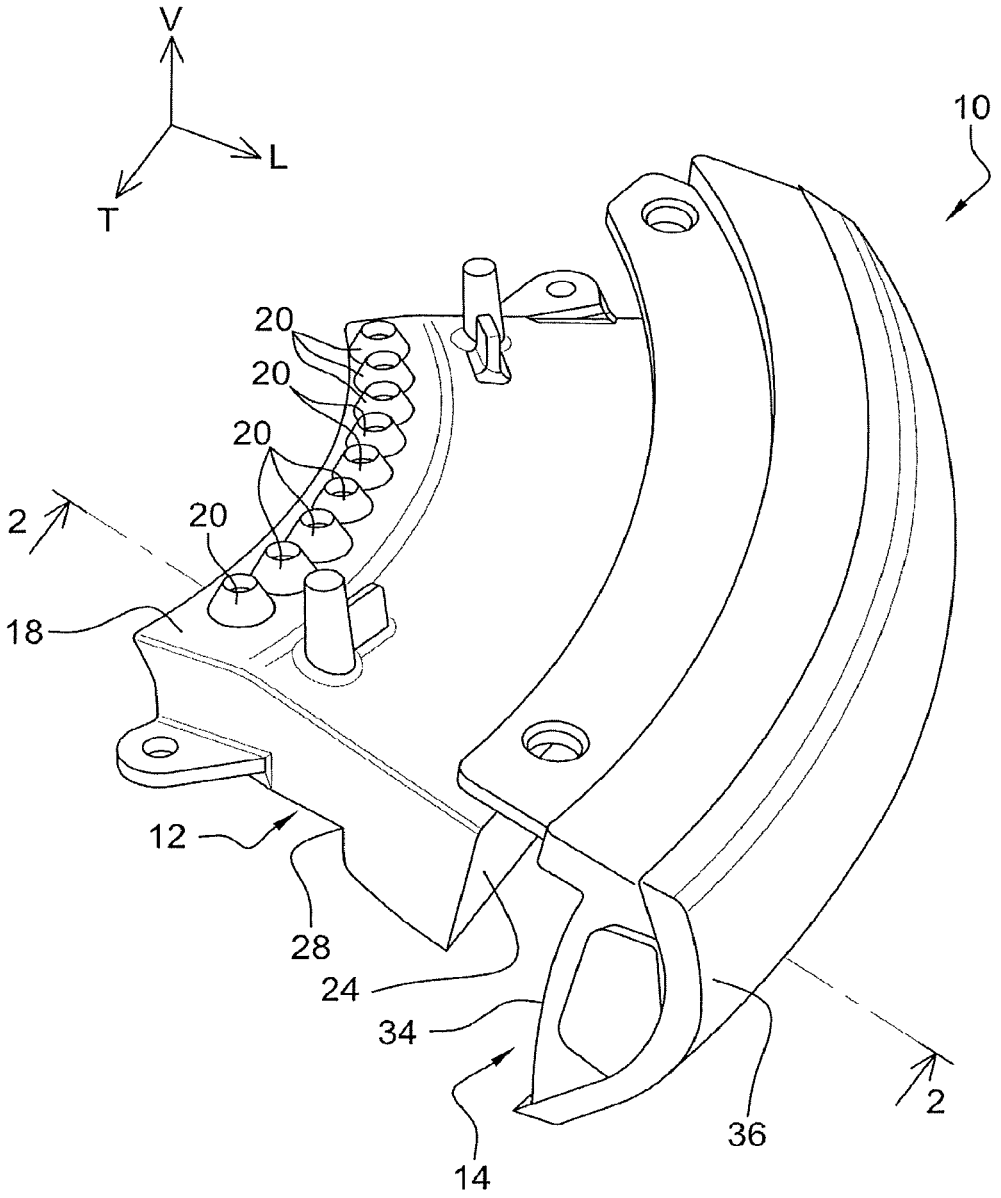
FIG. 1 is a perspective view from above which represents an optical module produced according to the teachings of the invention, the light sources having been omitted for reasons of clarity.

FIG. 1 shows an optical module 10 for a motor vehicle which is intended to emit a final beam with top cutoff in a longitudinal direction "L".

It is for example an optical module 10 participating in a low beam function. Such an optical module 10 is then arranged at the front of a motor vehicle (not represented) to light the road in front of the vehicle.

The optical module 10 mainly comprises a primary optical means 12 and a projection means 14.

Figure 2A:
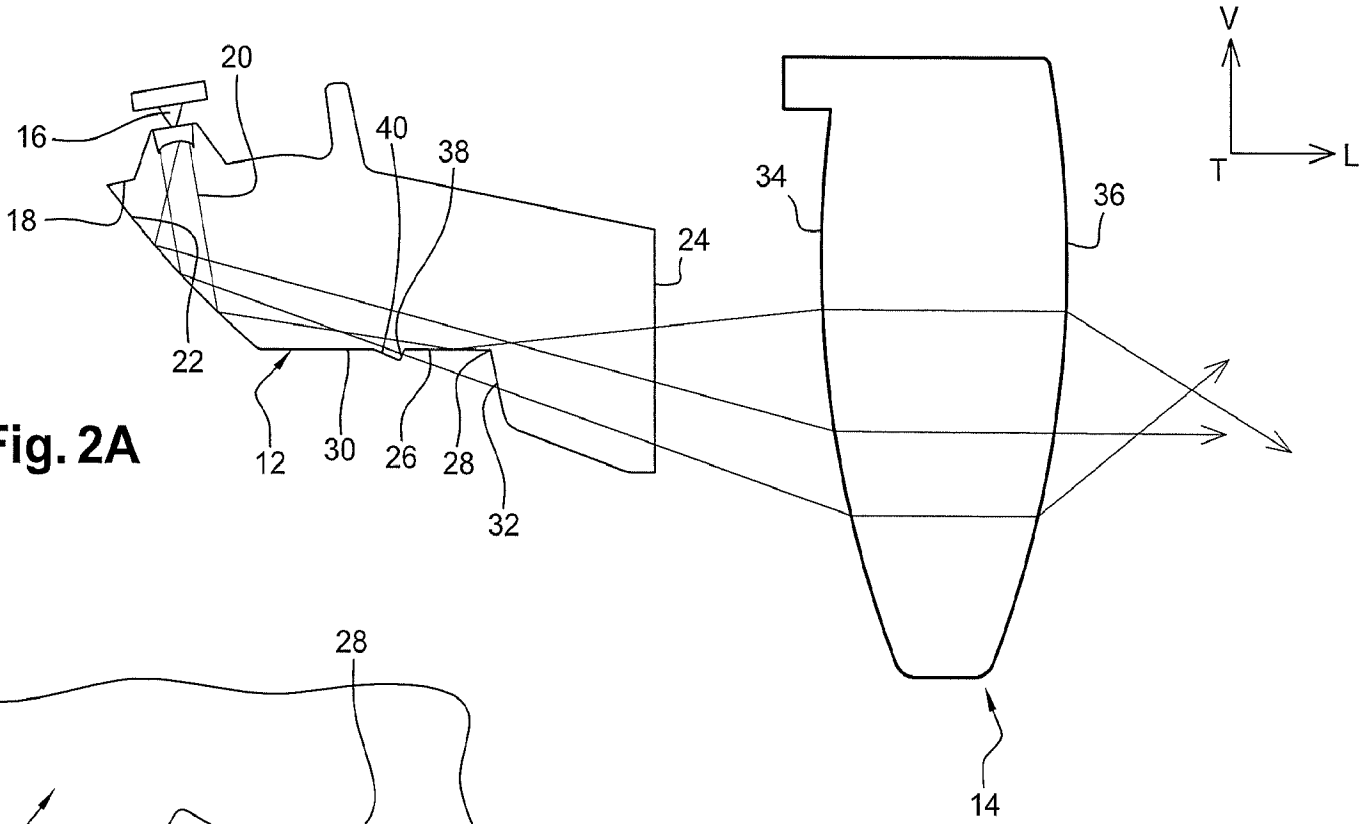
FIG. 2A is a sectional view according to the cutting plane 2-2 of FIG. 1 which represents the path of the light rays in the optical module of FIG. 1 from a light source to a final light beam.

As represented in FIG. 2A, the optical module 10 also comprises at least one light source 16, here two light sources 16. The light sources 16 are, here, formed by light-emitting diodes. Here, there are nine of them. The light-emitting diodes are all borne by a common printed circuit board which extends in a horizontal plane above the primary optical means 12.

Each light source 16 is capable of emitting, in a controlled manner, an initial light beam which is here directed substantially vertically downward toward an input face 18 of the primary optical means 12.

The primary optical means 12 is formed in a block by a solid part produced in a translucent or transparent material, such as polymethyl methacrylate (PMMA) or polycarbonate (PC). The primary optical means 12 comprises, in its rear upper part, said top horizontal input face 18.

The input face 18 is provided with a plurality of collimation members 20, each of which is associated with a light source 16. Each member 20 is formed here by a portion of input face 18 conformed as a lens to collimate the light rays of the initial light beam emitted by the associated light source 16. Thus, the rays from the light source 16 are propagated substantially in a vertical direction in the primary optical means 12.

The top input face 18 is arranged vertically above an internal total reflection face 22 which is arranged to receive the initial light beam thus collimated by the collimation member 20. This total reflection face 22 delimits the primary optical means 12 longitudinally toward the rear. It has a sloping inclined form to reflect the incident light rays overall toward the front toward a front output face 24 which delimits the optical means 12 toward the front.

The output face 24 is here generated by translation of its vertical section, forming a generatrix, in a direction of concave curvature extending in a horizontal plane. The light sources 16 are themselves aligned parallel to the curvature of the output face 24.

The primary optical means 12 is equipped with a cutoff member arranged to transform said reflected initial light beam into a secondary light beam oriented in a longitudinal direction and exhibiting a predetermined bottom cutoff extending overall transversely.

The cutoff member is formed by a slot 26 produced in a bottom face of the primary optical means 12. The slot 26 has a recessed top transverse edge 28, called cutoff edge 28, whose profile corresponds to the form of the predetermined cutoff. It is, here, a horizontal flat cutoff.

The cutoff edge 28 is more particularly formed by the intersection between a first, substantially horizontal upstream interception face 30 and a substantially vertical downstream second face 32 which extends below the cutoff edge 28.

The interception face 30 is contiguous to the total reflection face 22. It is arranged to totally reflect the light rays of the secondary beam above the edge 28 toward the output face 24. This interception face 30 thus guarantees that the light rays from the light sources 16 are directed above the cutoff edge 28. Thus, no light ray intended to form the beam with final cutoff passes through the vertical downstream face 32 of the slot 26.

The output face 24 arranged longitudinally downstream of the cutoff edge 28.

In a longitudinal vertical cutting plane, as illustrated in FIG. 2A, the total reflection face 22 is conformed as a parabola so as to focus the reflected light rays at the level of the cutoff edge 28.

The projection means 14 is arranged longitudinally downstream and at a distance from the output face 24 of the primary optical means 12. The projection means 14 is intended to project a final light beam exhibiting a top cutoff formed by an inverted image of the secondary light beam with cutoff projected by the output face 24 of the primary optical means 12.

Figure 4:
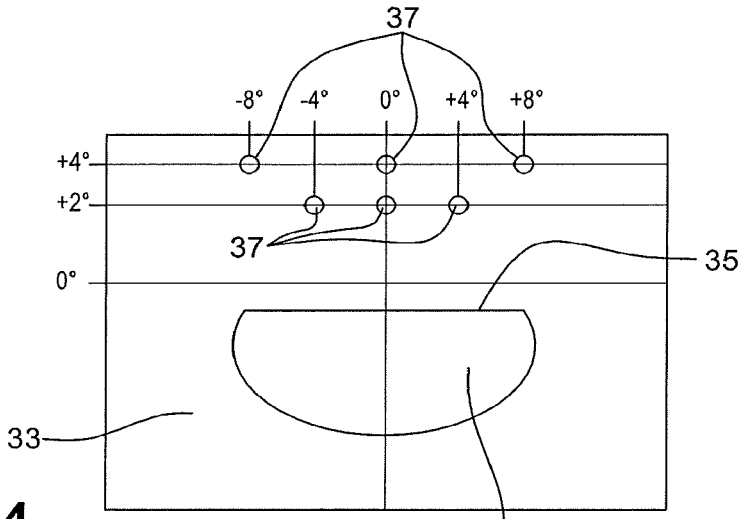
FIG. 4 is a front view which represents a screen lit by the final light beam emitted by the optical module of FIG. 1.

FIG. 4 illustrates the zone 31 lit by the final beam on a transverse vertical screen 33 placed at 25 meters from the lighting device, at right angles to the optical axis whose intersection with the screen 33 corresponds to the crossing between the x axis and the y axis. It can be seen that the zone lit by the final beam is delimited toward the top by a cutoff line 35. The cutoff line 28 has a horizontal rectilinear form. The final beam is, here, a regulatory low beam.

More particularly, the projection means 14 is formed by a lens produced in a piece of transparent or translucent material such as PMMA or PC. The lens comprises an input rear face 34 and an opposing projection face 36.

The input face 34 is arranged longitudinally at a distance from the output face 24 of the primary optical means 12 for the light rays to exit to the open air before entering into the projection means 14.

The projection means 14 is formed here by a part distinct from the primary optical means 12.

The projection means 14 is focussed at the level of the cutoff member. More particularly, the projection means 14 has a cylindrical form and it comprises a transverse focal line which coincides with the cutoff edge 28. This makes it possible to project a final light beam exhibiting a sharp cutoff formed by an inverted image of the cutoff edge 28. The image is of course inverted by vertical symmetry on either side of a horizontal focal plane passing through the cutoff edge 28.

According to the teachings of the invention, the primary optical means 12 comprises a light deflection member arranged to deflect a part of the light rays of the initial light beam below the cutoff of the secondary beam toward the projection means. Thus, these deflected light rays are projected upward after their passage through the projection means 14 to light overhead lights 37 arranged vertically above the cutoff line of the final light beam.

As represented in FIG. 4, here there are six of the overhead lights 37. A first group of three overhead lights 37 is aligned 2° above the cutoff, a central light and two lights 37 arranged at 4° transversely on either side of the central point. A second group of three overhead lights 37 is aligned at 4° above the cutoff line, a central light and two lights 37 arranged at 8° transversely on either side of the central light.

To this end, the deflection member is formed by an exit face 38 produced in the interception face 30. The exit face 38 more particularly forms an angle with the interception face 30 so as to transmit a part of the initial beam out of the primary optical means 12. The light rays from the collimated initial beam thus strike the exit face 38, directly or after reflection on the total reflection face 22, with an angle of incidence less than the angle of refraction such that said light rays pass through the exit face 38 to be directed toward the downstream vertical face 32, below the cutoff edge 28. Said deflected rays thus re-enter into the primary optical means 12 to be directed toward the output face 24, then to the projection means 14.

Given that the rays deflected by the exit face 38 pass under the cutoff edge 28, their image by the projection means 14 is projected above the cutoff line of the final beam. It will be understood that the position of the exit face 38 is determined such that the lights 37 lit by said deflected rays in the final beam correspond to the overhead lights 37.

In the example represented in FIG. 2A, the exit face 38 is produced in a bulge extending vertically protruding outward under the interception face 30. The bulge more particularly has a vertical longitudinal section in the form of a prism delimited to the front by said exit face 38 and to the rear by a rear face 40. The rear face 40 of the bulge is advantageously oriented so as to totally reflect the incident light rays toward the exit face 38 to participate in the lighting of the overhead lights 37. The light rays deflected by the deflection member are thus projected above the cutoff line of the final beam, to produce the regulatory function called "overhead light".

Figure 2B:
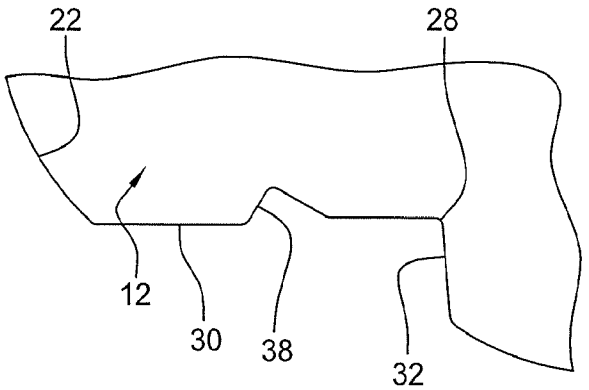
FIG. 2B is a larger scale detailed view similar to that of FIG. 2A which represents a variant embodiment of the optical module.

According to a variant of the invention represented in FIG. 2B, the exit face 38 is produced in a notch hollowed out in the interception face 22. In vertical section, the notch is thus delimited to the rear by said exit face 38.

Figure 3:
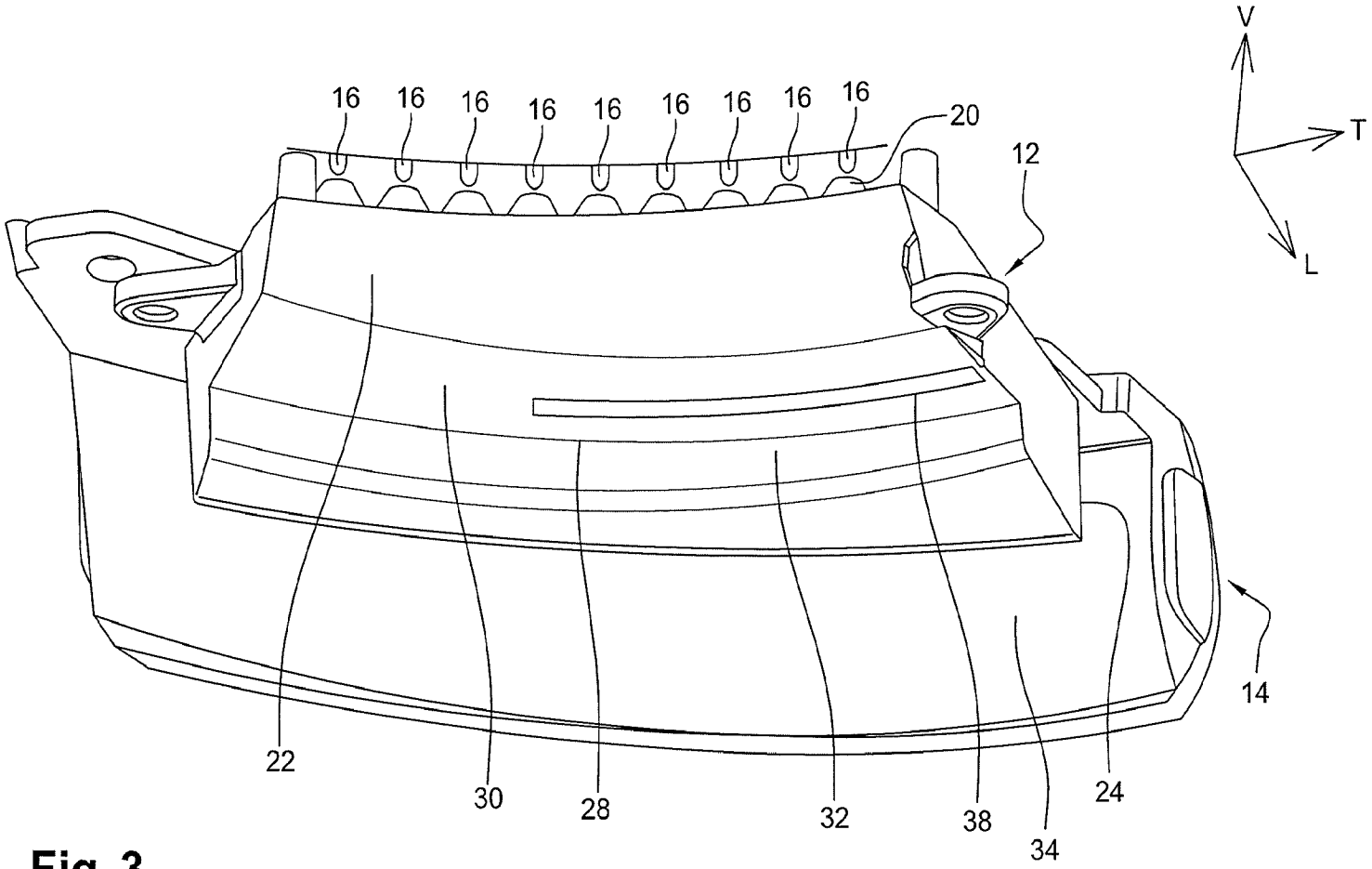
FIG. 3 is a perspective view from below which represents the optical module of FIG. 1.

As represented in FIG. 3, the exit face 38 extends, in a horizontal plane, parallel to the output face 24 of the primary optical means 12. The output face 24 having a curvature in a horizontal plane, the exit face 38 itself extends along a curved line. The exit face 38 extends continuously opposite several light sources 16, for example six light sources 16. These are the light sources 16 arranged on the left of FIG. 3. Thus, each of these six light sources 16 lights an associated overhead light.

In a variant not represented, the exit face extends discontinuously under the interception face. Each portion of an exit face is then arranged to coincide with an associated light source, each portion being separated transversely from the adjacent portion of exit face.

Figure 6:
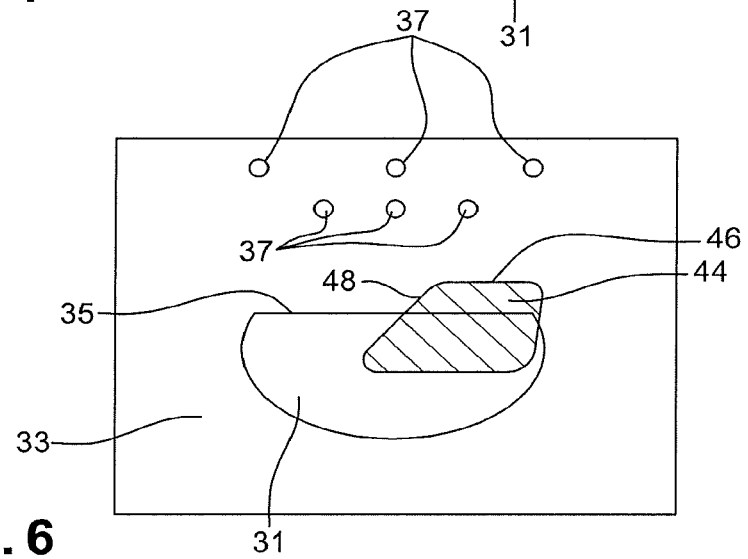
FIG. 6 is a view similar to that of FIG. 4 which represents the screen lit simultaneously by the optical module of FIG. 1 and the second optical module of the light device of FIG. 5.
Figure 5:
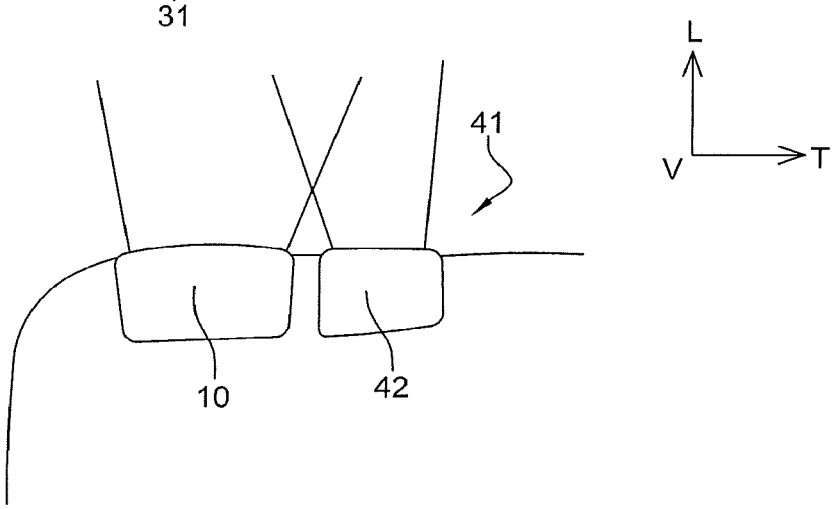
FIG. 5 is a plan view which represents a motor vehicle light device comprising the optical module of FIG. 1 associated with a second optical module to form a regulatory low light beam.

As is represented in FIG. 5, the optical module 10 previously described for example forms part of a light device 41 for motor vehicle comprising said first optical module 10 produced according to the teachings of the invention, and comprising a second optical module 42 capable of producing a segmented light beam which is intended to be switched on jointly the first optical module 10. The superpositioning of the light beams projected by the two optical modules 10, 42 makes it possible to produce a lighting function of regulatory low beam type as is illustrated in FIG. 6.

Thus, the area 31 of the screen 33 lit by the final light beam from the first optical module 10 remains as described previously. The overhead lights 37 also remain in their position.

A second area 44 lit by the second optical module 42 is superposed with the first lit area 31. This second area 44 has a top portion which extends above the cutoff line 35 of the first lit area 31 over a half of the screen 33, here the right half. This so-called top portion is delimited to the top by a first top horizontal line 46 and laterally to the center of the screen by an inclined second line 48, for example at 15°, which crosses the cutoff line 35 of the first area 31 substantially at the center of the screen 33.

Thus, the superpositioning of the two light beams lights a global area 31, 44 delimited to the top by a delimitation comprising a first bottom horizontal level 35, formed by the cutoff line 35 of the first area 31, an oblique second section 48 which prolongs the horizontal first level 35. This oblique section 48 is formed by the inclined line 48 of the second area 44. And finally, a second top level 46 formed by the top horizontal line 46 of the second area 44.

The horizontal first level 31 makes it possible to light the road by avoiding dazzling the drivers of oncoming vehicles, while the second level 46 makes it possible to light the side of the road with a greater range. The cutoff profile is here adapted for a vehicle running in a country requiring vehicles to run on the right of the road.

Optionally, the second optical module 42 can be controlled for the light beam to be displaced to the left or to the right according to the direction of pivoting of the wheels of the vehicle, the final light beam emitted by the first optical module 10 remaining fixed in relation to the vehicle. This makes it possible to give the light device 41 a "bending light" function, which makes it possible to optimally light the road in bends. The light beam can be displaced by pivoting of the second optical module 42 or even by selectively switching on light-emitting diodes forming a lighting matrix of the second optical module 42.

The optical module 10 produced according to the teachings of the invention makes it possible to form a beam with cutoff simultaneously lighting overhead lights.

The beam with cutoff and the overhead lights are lit simultaneously by the same light sources. Thus, this solution is particularly cost effective and compact since it does not require the use of light sources dedicated to the lighting of the overhead lights.

Furthermore, the light ray deflection member that makes it possible to light the overhead lights is arranged in the primary optical means 12. This primary optical means 12 is not directly visible to an observer when the optical module 10 is mounted on the vehicle. Because of this, the deflection member is not visible and the optical module retains an intact and refined esthetic appearance.

Moreover, the light device 41 implementing the optical module 12 produced according to the teachings of the invention makes it possible to light the overhead lights 37 in a fixed manner while allowing the production of a "bending light" by means of a second optical module 42.

The invention claimed is:

1. An optical module for a motor vehicle comprising:

at least one light source capable of emitting an initial light beam;

a primary optical device capable of receiving said initial light beam and comprising a cutoff slot arranged to transform said initial light beam into a secondary light beam oriented in a longitudinal direction, and the secondary light beam exhibiting a predetermined bottom cutoff extending overall transversely; and a lens arranged to project a final light beam exhibiting a top cutoff formed by an inverted image of the secondary light beam with the bottom cutoff, wherein the primary optical means comprises a light deflector arranged to deflect a part of the light rays of the initial light beam below the bottom cutoff of the secondary beam toward the lens, and wherein the lens is shaped to completely invert the secondary light beam such that the final light beam is vertically symmetrical to the secondary light beam across a horizontal focal plane of the lens.

2. The optical module according to claim 1, wherein the primary optical device is a solid part produced in a translucent or transparent material.

3. The optical module according to claim 2, wherein the deflector is formed by an exit face produced, the exit face forming an angle with an interception face so as to transmit a part of the initial beam out of the primary optical device below the cutoff slot and toward a downstream second face of the cutoff slot.

4. The optical module according to claim 2, wherein light rays deflected by the deflector are projected above the cutoff line of the final light beam, to produce overhead lights.

5. The optical module according to claim 2, wherein the primary optical device comprises at least one collimator for collimating the light rays emitted by the at least one light source.

6. The optical module according to claim 2, wherein the optical module comprises an output face arranged downstream of the cutoff slot.

7. An optical module for a motor vehicle comprising:

at least one light source capable of emitting an initial light beam;

a primary optical device capable of receiving said initial light beam and comprising a cutoff slot arranged to transform said initial light beam into a secondary light beam oriented in a longitudinal direction, and the secondary light beam exhibiting a predetermined bottom cutoff extending overall transversely; and a lens arranged to project a final light beam exhibiting a top cutoff formed by an inverted image of the secondary light mean with the bottom cutoff, wherein the primary optical means comprises a light deflector arranged to deflect a part of the light rays of the initial light beam below the bottom cutoff of the secondary beam toward the lens, and wherein the cutoff slot is produced in a bottom face of the primary optical device, the cutoff slot including a top transverse cutoff edge configured to create a predetermined cutoff of the final light beam.

8. The optical module according to claim 1, wherein the deflector is an exit face that forms an angle with an interception face so as to transmit a part of the initial beam out of the primary optical device below the cutoff slot and toward a downstream second face of the cutoff slot.

9. The optical module according to claim 8, wherein the exit face is a bulge that protrudes out of the primary optical device under the interception face.

10. The optical module according to claim 8, wherein the exit face is a notch hollowed out in the interception face.

11. The optical module according to claim 1, wherein light rays deflected by the deflector are projected above the cutoff line of the final light beam, to produce overhead lights.

12. The optical module according to claim 1, wherein the primary optical device comprises at least one collimator that collimates the light rays emitted by the at least one light source.

13. The optical module according to claim 12, wherein the primary optical device comprises an internal total reflection face which is arranged to receive the collimated light beam and to focus the collimated light beam at the level of the cutoff slot.

14. The optical module according to claim 1, further comprising an output face arranged downstream of the cutoff slot.

15. The optical module according to claim 1, wherein the lens is focused at the level of the cutoff slot.

16. The optical module according to claim 15, wherein the lens has a transverse focal line which coincides with an edge of the cutoff slot.

17. The optical module according to claim 7, wherein the cutoff edge is formed at an intersection between:

a first upstream interception face, extending substantially horizontally, which is arranged to reflect all light rays from the at least one light source above the cutoff edge toward the lens, and a downstream second face, substantially vertical, which extends below the cutoff edge.

18. A light device for a motor vehicle comprising a first optical module, the first optical module comprising:

at least one light source capable of emitting an initial light beam;

a primary optical device capable of receiving said initial light beam and comprising a cutoff slot arranged to transform said initial light beam into a secondary light beam oriented in a longitudinal direction, and the secondary light beam exhibiting a predetermined bottom cutoff extending overall transversely; and a lens arranged to project a final light beam exhibiting a top cutoff formed by an inverted image of the secondary light beam with the bottom cutoff, wherein the primary optical means comprises a light deflector arranged to deflect a part of the light rays of the initial light beam below the bottom cutoff of the secondary beam toward the lens; and the light device further comprising a second optical module configured to produce a segmented beam that can be switched on jointly with the light beam projected by the first optical module to produce a low beam light by super-positioning of the two light beams.

* * * * *